US005161858A

United States Patent [19]

Braun et al.

[11] Patent Number: 5,161,858

[45] Date of Patent: Nov. 10, 1992

[54] ARRANGEMENT FOR GUIDING A CUTTING MACHINE OR SIMILAR MINING MACHINE AT THE CONVEYOR TROUGH OF A DRAG-CHAIN CONVEYOR

[75] Inventors: Gert Braun; Ernst Braun, both of Essen, Fed. Rep. of Germany

[73] Assignee: Halbach & Braun Industrieanlagen, Fed. Rep. of Germany

[21] Appl. No.: 781,975

[22] Filed: Oct. 24, 1991

[30] Foreign Application Priority Data

Oct. 24, 1990 [DE] Fed. Rep. of Germany ..... 4033728

[51] Int. Cl.[5] ..... E21C 29/22

[52] U.S. Cl. ..... 299/43; 198/735.6

[58] Field of Search ..... 299/34, 42, 43; 198/735.6

[56] References Cited

FOREIGN PATENT DOCUMENTS 1911130 3/1978 Fed. Rep. of Germany ..... 299/43

1102942 7/1984 U.S.S.R. ..... 299/43

*Primary Examiner*—David J. Bagnell

*Attorney, Agent, or Firm*—Anderson Kill Olick & Oshinsky

[57] ABSTRACT

An arrangement for guiding on a coal bank side a coal cutting machine at a conveyor trough with guide section portions for a round-link chain which is engaged by a chain drum which drives the cutting machine. The abutting ends of the guide section portions are constructed without upper guides and have overlapping joint projections. In addition the abutting ends of the guide section portions are connected to each other through chain guide members which extend across the joint area. The chain guide members are connected through connecting bolts while maintaining a predetermined play to the trough portions, wherein the chain guide members have corresponding recesses in the area of the guide section portion which is free of upper guides. As a result, the round-link chain is guided so as to be aligned in the abutting areas and the round-link chain is easily accessible.

6 Claims, 4 Drawing Sheets

ARRANGEMENT FOR GUIDING A CUTTING MACHINE OR SIMILAR MINING MACHINE AT THE CONVEYOR TROUGH OF A DRAG-CHAIN CONVEYOR

BACKGROUND OF THE INVENTION

1. Field of the Invention

The present invention relates to an arrangement for guiding a coal cutting machine or similar mining machine at the conveyor trough of a drag-chain conveyor. The arrangement includes guide section portions of a machine guide section. The guide section portions are fastened on the side of the coal bank to the conveyor trough which is divided into trough portions. The arrangement further includes a drive arranged on the side of the coal bank for the coal cutting machine with a chain drum which engages a round-link chain. The round-link chain is arranged in a chain guide of the machine guide section with upper guide means for the horizontal chain members and an engagement groove for the chain drum. The guide section portions as well as the trough portions are connected at the abutting ends thereof in an articulated manner or so as to be capable of angling relative to each other.

2. Description of the Related Art

It is known in the art to connect trough portions at the abutting ends thereof in an articulated manner by means of bone-shaped connecting bolts which are arranged in longitudinal direction of the trough. The connecting bolts with increased thickness portions at the ends thereof have the purpose to facilitate a horizontal and vertical angling of the trough portions relative to each other.

Also known in the art are trough portions which are connected to each other with relative play, wherein the trough portions include guide members for the material being conveyed, and wherein the trough portions have their own trough connecting elements. The guide members have pins on the inner sides of the guide members in the region of the guide member ends, wherein a common connecting plate is provided for always two adjacent pins of guide members which are to be connected. The connecting plate has eyes separated by a connecting web for receiving the two pins. On the one hand, the two pins are surrounded by the connecting lug and, on the other hand, the connecting web is received with predetermined play between the pins.

However, the above-described features do not have a significant influence on the problems concerning the chain guidance for a coal cutting machine on the side of the coal bank.

SUMMARY OF THE INVENTION

Therefore, it is the object of the present invention to provide an arrangement for guiding on the side of the coal bank a coal cutting machine or similar mining machine of the above-described type, in which the round-link chain is guided in the joint areas of the trough portions and guide section portions with an aligned transition of the chain even if the trough portions and guide section portions are angled relative to each other in horizontal or vertical direction. In addition, the round-link chain is to be easily accessible for purposes of assembly, maintenance and repair.

In accordance with the present invention, in a guide arrangement of the above-described type, the abutting ends of adjacent guide section portions are constructed in the respective abutting area without upper guide means over a predetermined length and have joint projections which overlap each other. At least one of the joint projections of one of the guide section portions engages in a joint socket of the other guide section portion. The abutting ends of the adjacent guide section portions are connected to each other by means of chain guide members. The chain guide members are connected to the trough portions while maintaining a predetermined play by means of connecting bolts which extend through the guide section portions. The chain guide members have a recess which corresponds to the area of the guide section portions which is free of upper guide means.

The above-described features of the invention have the result that the round-link chain, which essentially acts as a drive chain for driving the cutting machine guided on the side of the coal bank, is guided smoothly and certainly aligned in the joint areas of the chopped portions or guide section portions. In this regard, the invention starts from the finding that in the joint areas of the guide section portions it is possible over a predetermined length to omit an upper guide means for the round-link chain or its horizontal members.

Because of the interruption of the upper guide means in accordance with the present invention, misalignments or bends in the chain are prevented even if the trough portions or guide section portions extend horizontally and/or at an angle. As a result, the joint areas are less endangered and a longer service life of the round-link chain is obtained. Moreover, because of the interruption in the upper guide means, the round-link chain is easily accessible in the joint areas of the trough portions or guide section portions. This is an advantageous feature with respect to the assembly as well as with respect to maintenance and repair, especially since now the chain joints are accessible.

Furthermore, because of the overlapping joint projections, an articulated connection with centering effect is realized which simultaneously covers the gaps between the adjacent trough portions and, consequently, prevents the discharge of fine coal. In this connection, the invention recommends that the overlapping joint projection of the other guide section portion receives the joint projection engaging in the joint socket with centering effect between the overlapping joint projection and the adjacent abutting ends of the trough portions.

In accordance with an important feature of the present invention, the center point of the joint is located in the plane of the bottom wall of the trough portions. As a result, the abutting ends of the bottom walls remain aligned relative to each other even when the trough portions are at an angle relative to each other, so that fine coal is prevented from passing from the upper part of the conveyor to the lower part of the conveyor.

The present invention further provides that the area of the abutting ends of the guide section portions without upper guide means and the recess in the chain guide plates are constructed as congruent concave arcs which extend above the center point of the joint. As a result, it is achieved that the trough portions and the guide section portions are continuously pressed down against the foot wall because of the fact that the conveyor chain travels above the center point of the joint and because of the laying of the round-link chain for driving the cutting machine.

The chain guide plates are preferably of spring steel, so that the capability of horizontal angling of the trough portions and guide section portions is optimized, wherein this capability already exists because of the play of the connecting bolts in the region of the chain guide plates.

The connecting bolts are preferably constructed as threaded bolts and rest against the guide section portions with the intermediate arrangement of spacer sleeves which extend through oblong holes provided in the chain guide plate. As a result, when the connecting bolts are tightened, the guide section portions are not clamped between the trough portions and the chain guide plates, but rather the mobility is maintained for horizontal and vertical angling.

Due to the overlapping joint projections and the spring-elastic chain guide plates, an elastic joint connection is obtained between the guide sections for the round-link chain as well as for the trough portions.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
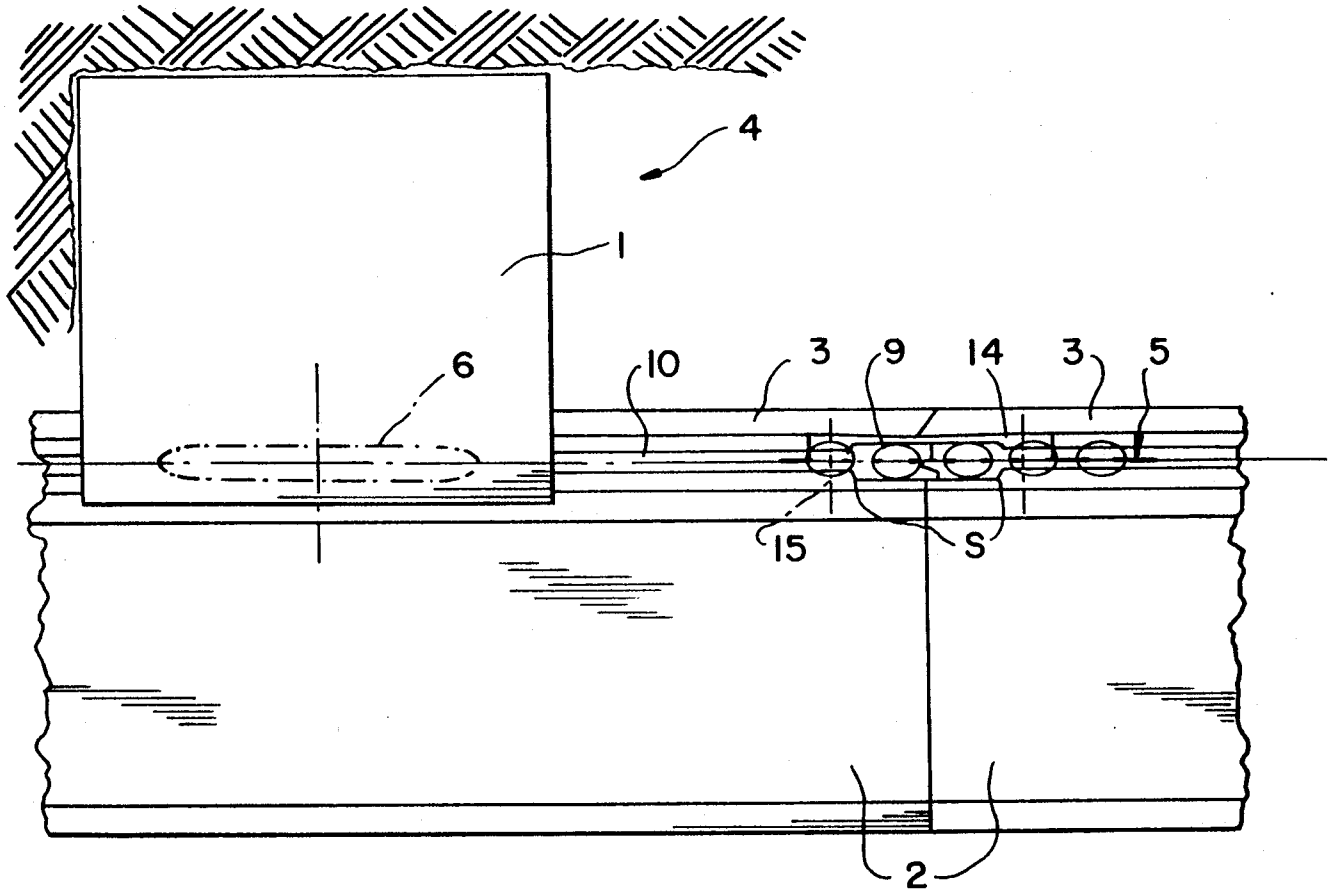
FIG. 1 is a partial schematic view of a conveyor trough with chain guide sections on the side of the coal bank and with a coal cutting machine.
Figure 4:
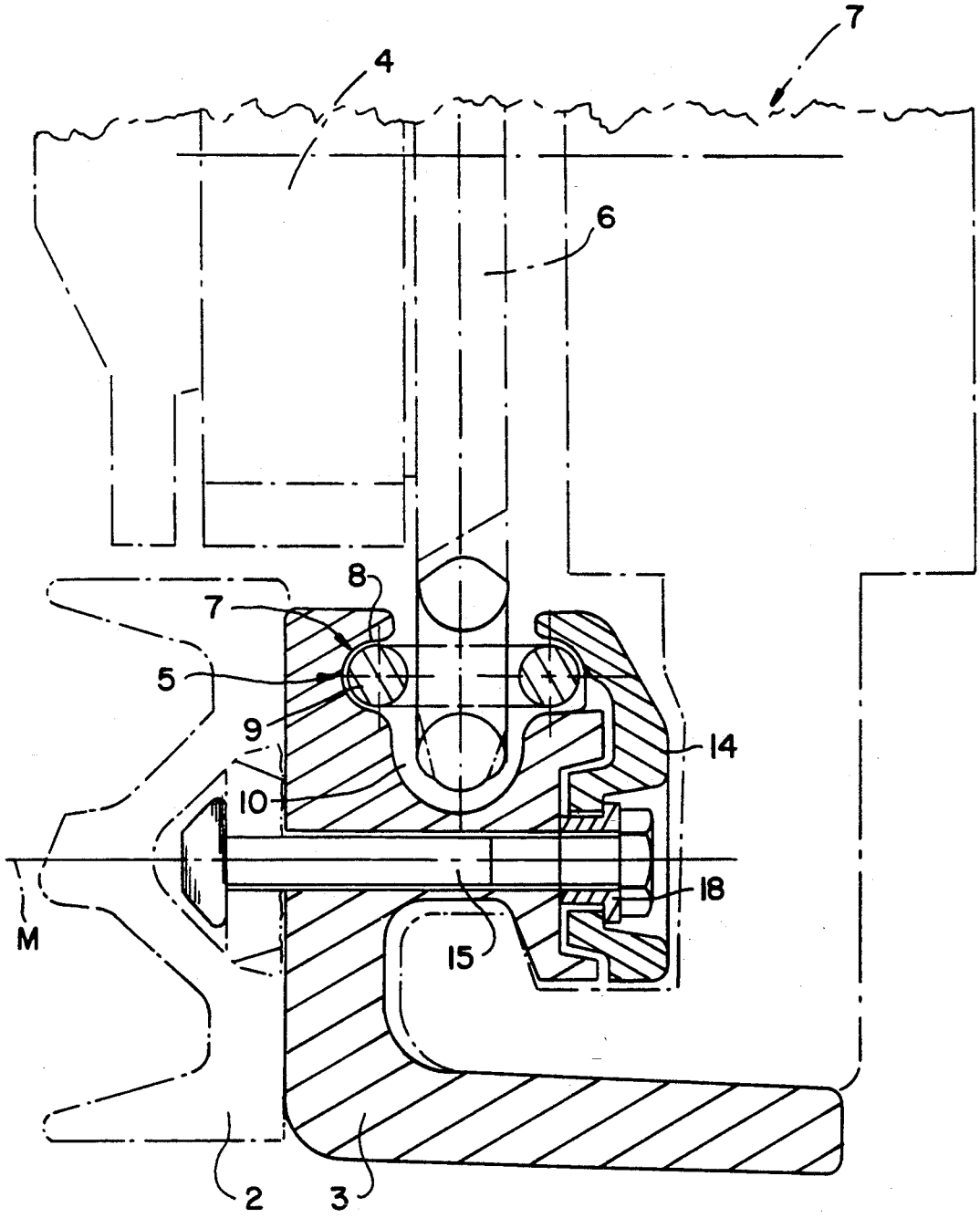
FIG. 4 is a vertical sectional view taken along sectional line Y—Y of FIG. 2.

The figures of the drawing show an arrangement for guiding a coal cutting machine 1 at the conveyor trough of a drag-chain conveyor. As shown in FIG. 1, the arrangement includes guide section portions 3 of a machine guide section mounted on the side of the coal bank to the conveyor trough which is divided into trough portions 2. The arrangement further includes a drive 4 for the cutting machine 1. This drive 4 includes a round-link chain 5 which serves as a driving chain and a driven chain drum 6 which engages in the round-link chain 5. As shown in FIG. 4, the round-link chain 5 is arranged in an upper chain guide 7 of the machine guide section with upper guide means 8 for the horizontal chain links 9 and engagement groove 10 for the chain drum 6. The guide section portion 3 as well as the trough portions 2 are connected at the abutting ends thereof so as to be capable of angling horizontally and vertically relative to each other.

Figure 2:
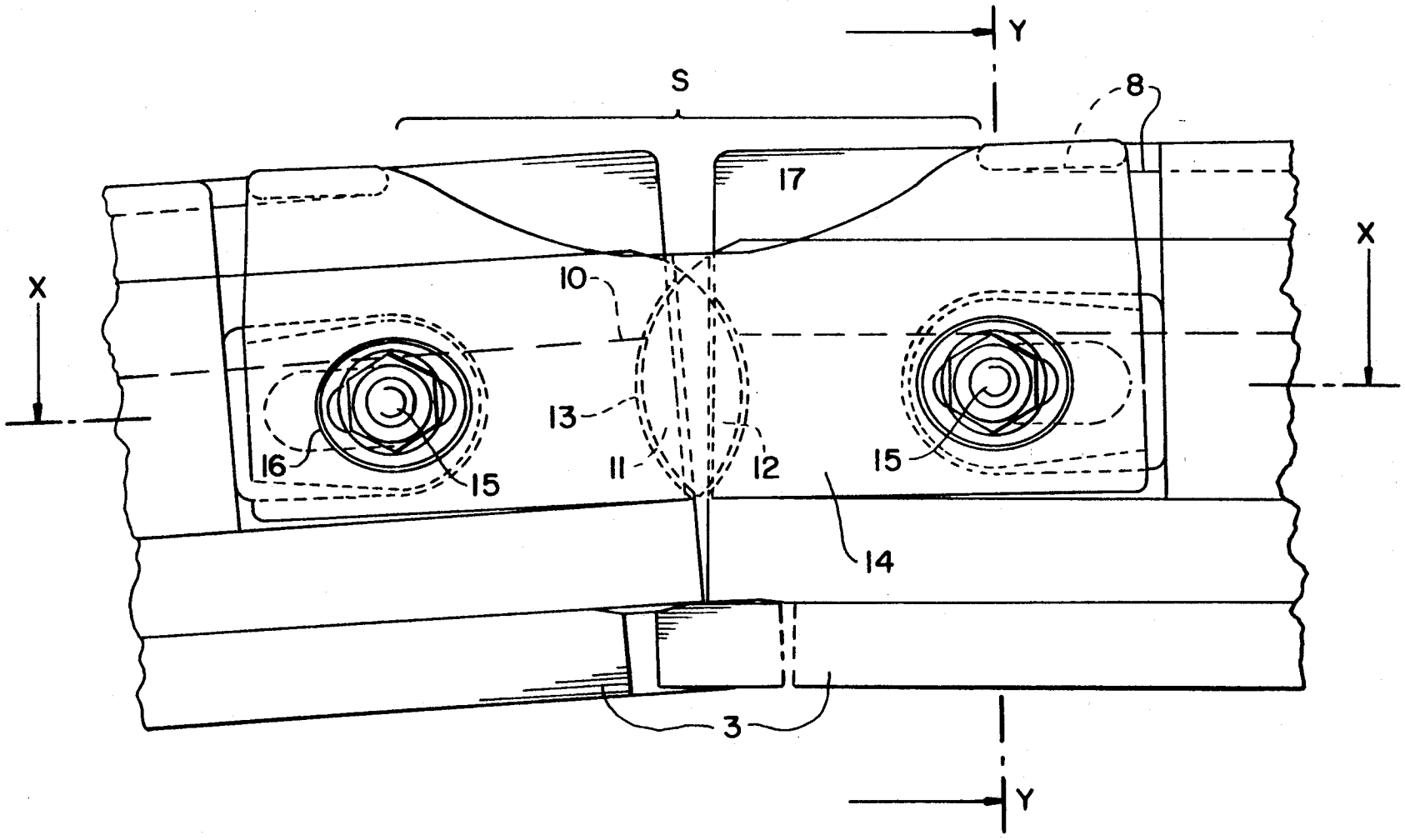
FIG. 2 is a partial side view of the conveyor trough of FIG. 1 seen in the joint area between two trough portions or guide section portions.
Figure 3:
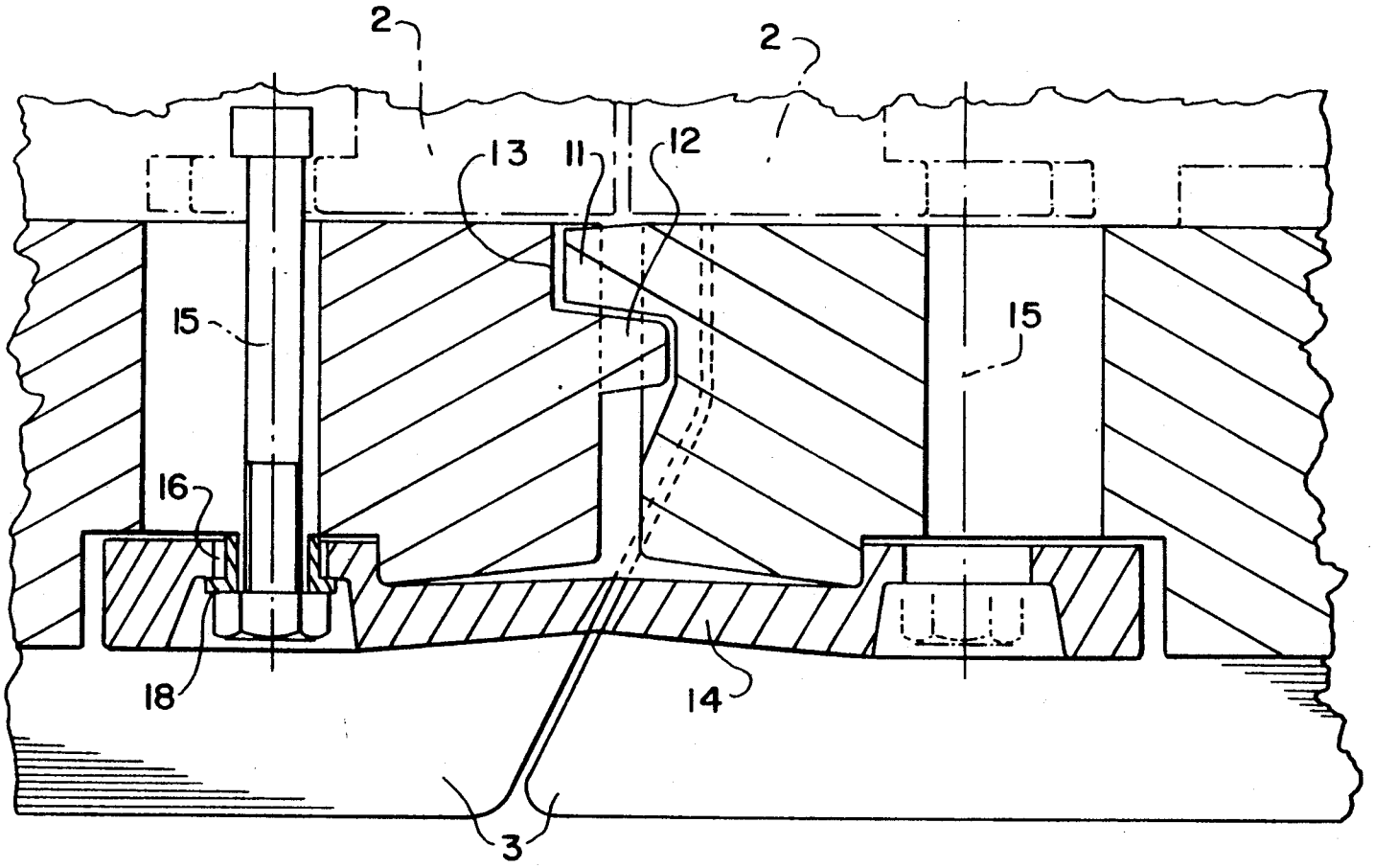
FIG. 3 is a horizontal sectional view taken along sectional line X—X of FIG. 2.

As illustrated in FIG. 2, the abutting ends of adjacent guide section portions 3 have in the joint area an upper guide interruption S over a predetermined length. In other words, the guide section portions 3 are constructed without upper guide means at the joint area. In addition, the guide section portions 3 have overlapping joint projections 11, 12. At least one joint projection 11 of one guide section portion 3 engages in a joint socket 13 of the other guide section portion 3. The abutting ends of adjacent guide section portion 3 are connected to each other by means of chain guide members 14 which extend across the joint area.

The chain guide members 14 are connected to the trough portions 2 by means of connecting bolts 15 which extend through the guide section portion 3, wherein a predetermined play is maintained as indicated by reference numeral 16. The chain guide sections 14 have a recess 17 which corresponds to the length S without upper guide means of the guide section portion 3. The overlapping joint projection 12 of the other guide section portion 3 receives the joint projection 11 of the one guide section portion which engages the joint socket 13 with a centering effect between the overlapping joint projection 12 and the adjacent abutting ends of the trough portions 2.

As can be seen in FIG. 4, the center M of the joint is located in the plane of the bottom wall of the trough portions 2. The length S without upper guide means at the abutting ends of the guide section portion 3 and the recess 17 in the respective chain guide member 14 are constructed as congruent concave arcs which extend above the joint center M. The chain guide members 14 are of spring steel. The connecting bolts 15 are constructed as threaded bolts and rest against the guide section portions 3 with spacer bushings 18 which extend through oblong holes 16 in the chain guide member 14 being arranged between the connecting bolts 15 and the guide section portions 3.

While a specific embodiment of the invention has been shown and described in detail to illustrate the application of the inventive principle, it will be understood that the invention may be embodied otherwise without departing from such principles.

We claim:

1. In an arrangement for guiding a mining machine at a conveyor trough of a drag-chain conveyor, the arrangement including guide section portions of a machine guide section, the guide section portions being fastened on a coal bank side to the conveyor trough, the conveyor trough being composed of a plurality of trough portions, the arrangement further including a drive arranged on the coal bank side for the mining machine with a chain drum which engages a round-link chain, the round-link chain being arranged in a chain guide of the machine guide section with upper guide means for the horizontal chain members and an engagement groove for the chain drum, the guide section portions and the trough portions being connected at the abutting ends thereof in an articulated manner, the improvement comprising the abutting ends of adjacent guide section portions being constructed in the abutting area without upper guide means over a predetermined length and having joint projections which overlap each other, at least one of the joint projections of one of the guide section portions engaging in a joint socket of the other guide section portion, the abutting ends of the adjacent guide section portions being connected to each other by means of chain guide members, the chain guide members being connected to the trough portions while maintaining a predetermined play by means of connecting bolts which extend through the guide section portions, each chain guide member having a recess which corresponds to the area of the guide section portions which is free of upper guide means.

2. The arrangement according to claim 1, wherein the overlapping joint projection of the other guide section portion receives the joint portion engaging in the joint socket with a centering effect between the overlapping joint portion and the adjacent abutting ends of the trough portions.

3. The arrangement according to claim 1, wherein the trough portions have bottom walls extending in a plane, the joint having a center point, the center point being located in the plane of the bottom walls.

4. The arrangement according to claim 3, wherein the portion of the abutting ends of the guide section portions without upper guide means and the recess in the chain guide members are constructed as congruent concave arcs which extend above the center point.

5. The arrangement according to claim 1, wherein the chain guide members are of spring steel.

6. The arrangement according to claim 1, wherein the connecting bolts are threaded bolts, the chain guide members having oblong holes, the threaded bolts being supported by the guide section portions, wherein spacer bushings extending through the oblong holes are arranged between the threaded bolts and the guide section portions.

* * * * *